US008603297B2

(12) United States Patent
Zwick et al.

(10) Patent No.: US 8,603,297 B2
(45) **Date of Patent: *Dec. 10, 2013**

(54) DISPERSIBLE WET WIPES CONSTRUCTED WITH A PLURALITY OF LAYERS HAVING DIFFERENT DENSITIES AND METHODS OF MANUFACTURING

(75) Inventors: Kenneth John Zwick, Neenah, WI (US); Jun Zhang, Appleton, WI (US); Kroy Donald Johnson, Neenah, WI (US); Nathan John Vogel, Neenah, WI (US); Robert Irving Gusky, Appleton, WI (US); David James Sealy Powling, Combined Locks, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/568,914

(22) Filed: Aug. 7, 2012

(65) Prior Publication Data

US 2012/0297560 A1 Nov. 29, 2012

Related U.S. Application Data

(63) Continuation of application No. 12/977,527, filed on Dec. 23, 2010, now Pat. No. 8,257,553.

(51) Int. Cl.
*D21F 11/00* (2006.01)

(52) U.S. Cl.
USPC ..... 162/158

(58) Field of Classification Search
USPC ..... 162/158; 428/156, 340, 271; 442/361
See application file for complete search history.

(56) References Cited

U.S. PATENT DOCUMENTS

| | | | | |
|---|---|---|---|---|
| 5,629,081 | A | 5/1997 | Richards et al. | |
| 6,028,018 | A | 2/2000 | Amundson et al. | |
| 6,381,817 | B1 | 5/2002 | Moody, III | |
| 6,503,855 | B1 | 1/2003 | Menzies et al. | |
| 6,782,589 | B2 | 8/2004 | Ngai | |
| 6,808,791 | B2 | 10/2004 | Curro et al. | |
| 7,425,517 | B2 | 9/2008 | Deka et al. | |
| 8,257,553 | B2 * | 9/2012 | Zwick et al. | 162/158 |
| 2003/0203162 | A1 | 10/2003 | Fenwick et al. | |
| 2004/0253297 | A1 | 12/2004 | Hedges et al. | |
| 2005/0136772 | A1 | 6/2005 | Chen et al. | |
| 2005/0148262 | A1 | 7/2005 | Varona et al. | |
| 2005/0214335 | A1 | 9/2005 | Allen et al. | |
| 2007/0141936 | A1 | 6/2007 | Bunyard et al. | |
| 2009/0088359 | A1 | 4/2009 | Denton | |
| 2010/0227138 | A1 | 9/2010 | Ouellette | |

* cited by examiner

*Primary Examiner* — Mark Halpern
(74) *Attorney, Agent, or Firm* — Kimberly-Clark Worldwide, Inc.

(57) ABSTRACT

A dispersible wet wipe constructed of at two layers is disclosed. A triggerable binder composition binds said web substrate together. The wet wipe also includes a wetting composition including at least 0.3 percent of an insolubilizing agent.

14 Claims, 3 Drawing Sheets

DISPERSIBLE WET WIPES CONSTRUCTED WITH A PLURALITY OF LAYERS HAVING DIFFERENT DENSITIES AND METHODS OF MANUFACTURING

This application is a continuation of application Ser. No. 12/977,527 filed on Dec. 23, 2010 now U.S. Pat. No. 8,257,553. The entirety of application Ser. No. 12/977,527 is hereby incorporated herein by reference.

BACKGROUND

Dispersible flushable moist products must exhibit satisfactory in-use strength, but quickly break down in sewer or septic systems. Current flushable moist wipes do this by using a triggerable salt sensitive binder on a substrate comprising cellulose based fibers. The binder attaches to cellulose fibers which form a network of in-use strength in a salt solution (used as the moist wipe formulation), but swells and falls apart in the fresh water of the toilet and sewer system.

Additionally, flushable moist wipes need to easily pass through current municipal sewer systems. For many years, the problem of disposability has plagued industries that provide disposable items, such as diapers, wet wipes, incontinence garments and feminine care products. Ideally, when a flushable disposable product is discarded in either sewer or septic systems, the product, or designated portions of the product, should "disperse" and thus sufficiently dissolve or disintegrate in water so as not to present problems under conditions typically found in household and municipal sanitization systems. Some products have failed to properly disperse. Many current wipe manufacturers achieve acceptable strength in flushable moist wipes by using long fibers (>10 mm) which entangle with other fibers to develop a wet strength network. However, these long fibers are not desirable because they tend to collect on screens in waste water systems and cause obstructions and blockages.

In response to increased concerns for blockages, INDA/EDANA published guidelines for assessing flushability of nonwoven consumer products, the scope of the document covering flushable moist wipes. By following these guidelines, manufacturers can ensure that under normal usage conditions products best disposed of via the waste water systems for public health and hygiene reasons will not block toilets, drainage pipes, water conveyance and treatments systems or become an aesthetic nuisance in surface waters or soil environments.

One challenge for flushable moist wipes is that it takes much longer to break down when compared to dry toilet tissue potentially creating issues in sewer or septic systems. Currently dry toilet tissue quickly exhibits lower post-use strength when exposed to tap water whereas current flushable moist wipes take time and/or agitation.

To achieve faster dispersion times with current binder technologies requires lower in-use strength that is deemed unacceptable by current consumers. Dispersibility could also be improved by curing/drying the binder less, but again provides unacceptable in-use strength. High density thin tissue webs with short fibers have been used to prepare wipes as well.

However, one problem with these wipes formed from a thin, dense and compact single ply is that such wipes tend to lack the superior softness that is desired by consumers. Further, the bulk and resiliency of such wipes is less than desirable. A single ply tissue web does not provide the smooth, bulky, resilient feel that consumers prefer in tissues of this type.

Other manufactures use shorter fibers in an airlaid nonwoven structure and bond them together with binder. However, at low densities, large amounts of binder are needed to bond the widely spaced network and this results in a relatively stiff, nonconformable sheet, and if the density is increased to reduce the binder needed the sheet loses stretch, thickness and softness.

What is needed in the industry is a multi-ply product that is durable and soft having increased resiliency and enhanced substance in hand. Unfortunately, these approaches to addressing the dispersibility problems above provide unacceptable strength or products that do not disperse quickly enough. Thus, there is a need to provide a wet wipe that provides proper in-use strength for consumers and still feels soft and comfortable, but disperses more like toilet paper to pass various municipal regulations and be defined as a flushable product.

SUMMARY

The present disclosure generally relates to dispersible wet wipes. More particularly, the disclosure relates to a dispersible wet wipe constructed of at least a first layer and a second layer. A triggerable binder composition binds the wet wipe together. The wet wipe also includes a wetting composition including at least 0.3 percent of an insolubilizing agent.

In an exemplary embodiment, the first outer layer of the wipe substrate may be a tissue web, and more desirably, an uncreped through-air dried tissue web. The second outer layer of the wipe substrate may be a nonwoven web.

The amount of binder composition present on the wipe substrate may desirably range from about 1 to about 15 percent by weight based on the total weight of the wipe substrates. More desirably, the binder composition may range from about 1 to about 8 percent by weight based on the total weight of the wipe substrate.

The dispersible wet wipes must have the desired in-use strength. As disclosed herein, the dispersible wipes may possess an in-use wet tensile strength of at least about 300 grams per linear inch. The dispersible wipes may possess an in-use wet tensile strength of at least about 300 grams per linear inch.

The dispersible wet wipe may also have a caliper value of greater than about 0.6 mm and a plate stiffness of less than 0.75 N*mm.

BRIEF DESCRIPTION

As used herein, unless otherwise stated, when the same reference number is used in more than one figure, it is intended to represent the same feature.

DETAILED DESCRIPTION

The present disclosure generally relates to dispersible wet wipes. More particularly, the disclosure relates to a dispersible wet wipe constructed of at least two layers. The first outer layer of the wipe substrate may have a density of between about 0.5 and 2.0 grams per cubic centimeter. The second outer layer may have a density of between about 0.05 and 0.15 grams per cubic centimeter. A triggerable binder composition binds said web substrate together. The wet wipe also includes a wetting composition including at least 0.3 percent of an insolubilizing agent.

The first outer layer is refined to higher density levels required to achieve target strength values, while the second outer layer with lower density levels provides softness and increased caliper. A key component in wipe softness is sheet stiffness or resistance to folding. Therefore, the layering is expected to play a key role in reducing sheet stiffness at the required overall tensile strength. Ideally, the desired overall strength would be carried in the very high density first layer with low thickness (for low stiffness). The second layer(s) would comprise low density fibers to provide a softer feeling higher bulk sheet. This softer feel and higher bulk gives the necessary soft feel to the wipe substrate.

In an exemplary embodiment, the caliper of the dispersible wet wipe may be ranging from at least 0.5 mm. More desirably, the wet wipe may have a caliper ranging from between about 0.5 and about 1.0 mm. Even more desirably, the wet wipe may have a caliper ranging from at between 0.6 to about 1.0 mm. Most desirably, the wet wipe may have a caliper ranging from at between 0.6 to about 0.85 mm.

In an exemplary embodiment, the stiffness value of the dispersible wet wipe may range from less than about 0.75 N*mm. More desirably, the wet wipe may have a stiffness value ranging from at between 0.1 to about 0.5 N*mm.

In addition, cup crush values can be used as an indication of softness of materials that may contact the skin, such as a wipe. Lower cup crush values indicate an increased feeling of gentleness and softness of the wipe as it glides across the skin.

Typically, the cup crush value for a wipe incorporating skin aesthetic agents of the present disclosure will be from about 10 to about 50 grams. Dynamic cup crush values may be measured as described in the examples.

Figure 1:
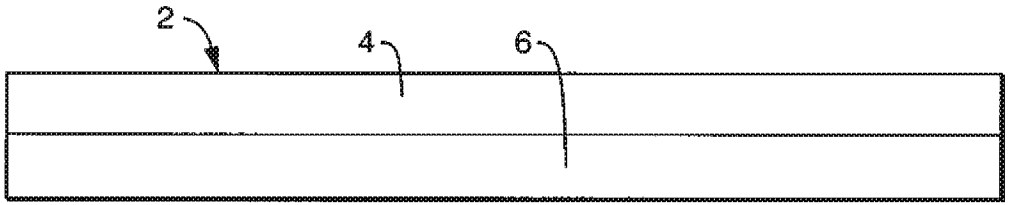
FIG. 1 is a cross-sectional view of the dispersible wet wipe disclosed herein.

Referring to FIG. 1, a dispersible wet wipe is illustrated having as least two outer layers. The first layer of the wipe substrate may have a density of between about 0.5 and 2.0 grams per cubic centimeter. Typically, the first layer of the fibrous substrate may have a basis weight of from about 20 to about 100 grams per square meter and desirably from about 20 to about 90 grams per square meter. Most desirably, the wipes of the present disclosure define a basis weight from about 30 to about 75 grams per square meter.

Materials suitable for the substrate of the wipes are well know to those skilled in the art, and are typically made from a fibrous sheet material which may be either woven or nonwoven. Two types of nonwoven materials are described herein, the "nonwoven fabrics" and the "nonwoven webs". The nonwoven material may comprise either a nonwoven fabric or a nonwoven web. The nonwoven fabric may comprise a fibrous material, while the nonwoven web may comprise the fibrous material and a binder composition. In another embodiment, as used herein, the nonwoven fabric comprises a fibrous material or substrate, where the fibrous material or substrate comprises a sheet that has a structure of individual fibers or filaments randomly arranged in a mat-like fashion, and does not include the binder composition. Since nonwoven fabrics do not include a binder composition, the fibrous substrate used for forming the nonwoven fabric may desirably have a greater degree of cohesiveness and/or tensile strength than the fibrous substrate that is used for forming the nonwoven web. For this reason nonwoven fabrics comprising fibrous substrates created via hydroentangling may be particularly preferred for formation of the nonwoven fabric. Hydroentangled fibrous materials may provide the desired in-use strength properties for wet wipes that comprise a nonwoven fabric.

For example, suitable materials for use in the wipes may include nonwoven fibrous sheet materials which include tissue, meltblown, coform, airlaid, bonded-carded web materials, hydroentangled materials, spunlace materials, and combinations thereof. Such materials can be comprised of synthetic or natural fibers, or a combination thereof.

Desirably, the first layer of the dispersible wipes is constructed from tissue webs. Basesheets suitable for this purpose can be made using any process that produces a high density, resilient tissue structure. Such processes include uncreped through-air dried, creped through-air dried and modified wet press processes. Desirably, the first layer of the wipe substrate is an uncreped through-air dried tissue basesheet. Exemplary processes to prepare uncreped through-air dried tissue are described in U.S. Pat. Nos. 5,607,551, 5,672,248, 5,593,545, 6,083,346 and 7,056,572, all herein incorporated by reference.

Figure 2:
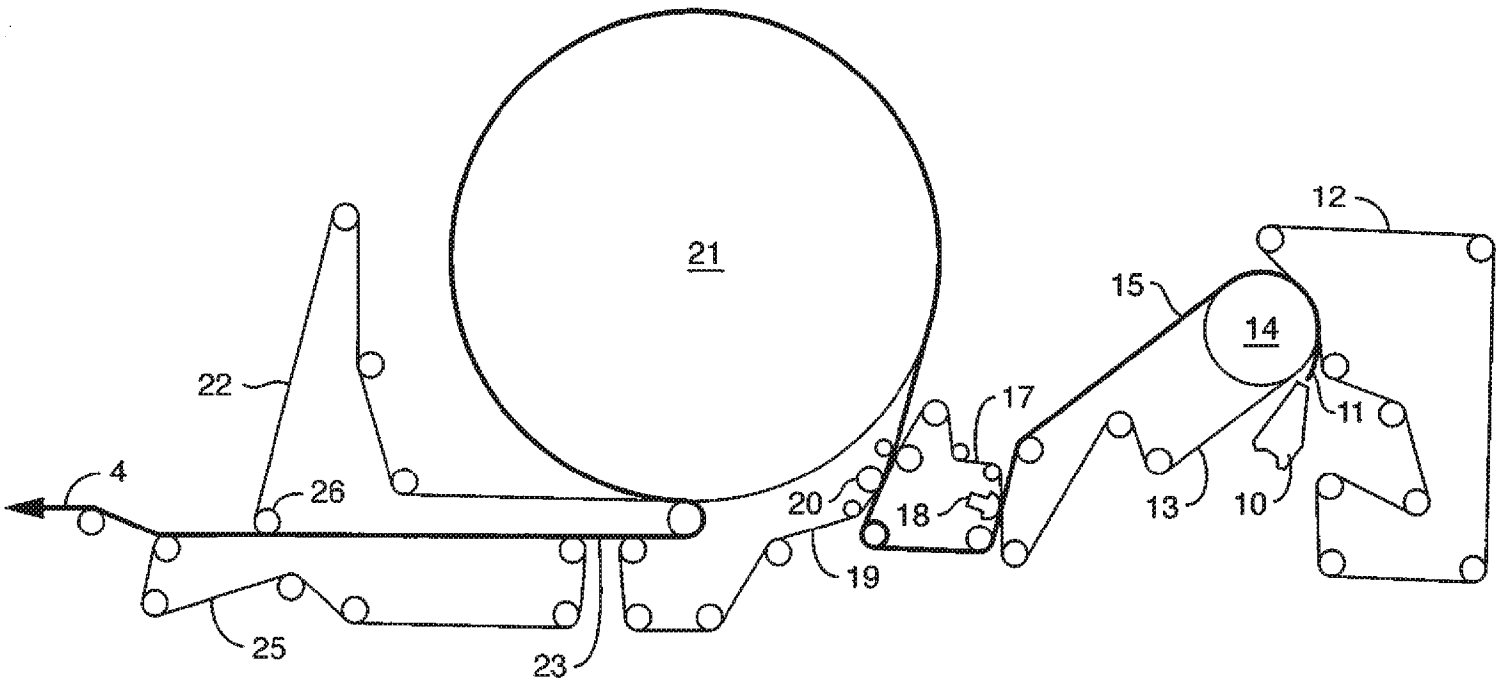
FIG. 2 is a schematic illustration of a flow diagram of an uncreped through-air dried tissue making process to form an exemplary first layer of the dispersible wet wipe.

FIG. 2 illustrates a machine for carrying out the method of forming the first layer of the wipe defined herein. (For simplicity, the various tensioning rolls schematically used to define the several fabric runs are shown but not numbered. It will be appreciated that variations from the apparatus and method illustrated in FIG. 2 can be made without departing from the scope of the claims.) Shown is a twin wire former having a layered papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Additional dewatering of the wet web can be carried out; such as by vacuum suction, while the wet web is supported by the forming fabric.

The wet web is then transferred from the forming fabric to a transfer fabric 17 traveling at a slower speed than the forming fabric in order to impart increased stretch into the web. Transfer is preferably carried out with the assistance of a vacuum shoe 18 and a fixed gap or space between the forming fabric and the transfer fabric or a kiss transfer to avoid compression of the wet web.

The web is then transferred from the transfer fabric to the through-air drying fabric 19 with the aid of a vacuum transfer roll 20 or a vacuum transfer shoe, optionally again using a fixed gap transfer as previously described. The through-air drying fabric can be traveling at about the same speed or a different speed relative to the transfer fabric. If desired, the through-air drying fabric can be run at a slower speed to further enhance stretch. Transfer is preferably carried out with vacuum assistance to ensure deformation of the sheet to conform to the through-air drying fabric, thus yielding desired bulk and appearance.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the through-air drying fabric, the web is final dried to a consistency of about 94 percent or greater by the through-air dryer 21 and thereafter transferred to a carrier fabric 22. The dried basesheet 23 that is prepared is the first layer of the dispersible wipe. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the first layer of the basesheet. The resulting sheet produced is the first layer of the dispersible substrate.

Desirably, the first layer comprises fibers that have fiber lengths that are less than 3 mm. By having fiber lengths of less than 3 mm and providing the proper cure to the dispersible binder, it will bring the fibers closer together so the dispersible binder can build an acceptable in-use network, but still break up effectively to individual fibers. Therefore, the broken-down product will be able to effectively pass through the smallest wastewater treatment screens, or sieves, just like toilet paper. Optimizing basesheet properties and process conditions allows above average in-use strength generation while improving flushability of the product, with less risk to wastewater treatment facilities.

To provide a wipe substrate with the requisite strength, good formation of high basis weight tissue in the first layer is beneficial. Providing good formation of the substrate provides the ability to deliver strength with significantly less binder and without the need of longer fibers.

Referring again to FIG. 1, the second outer layer of the wipe substrate may have a density of between about 0.05 and 0.15 grams per cubic centimeter. Typically, the first layer of the fibrous substrate may have a basis weight of from about 10 to about 100 grams per square meter and desirably from about 10 to about 60 grams per square meter. Most desirably, the wipes of the present disclosure define a basis weight from about 10 to about 45 grams per square meter. The two substrates are embossed together to bring the fibers closer together, ensuring proper bonding of the two outer layers.

One embodiment of a process for forming the second layer as described herein will now be described in detail with particular reference to FIG. 3. It should be understood that the air laying apparatus illustrated in FIG. 3 is provided for exemplary purposes only and that any suitable air laying equipment may be used in the process.

Various suitable forming fabrics for use can be made from woven synthetic strands or yarns. One suitable forming fabric is an ElectroTech 100S, available from Albany International having an office in Albany, N.Y. The ElectroTech 100S fabric is a 97 by 84 count fabric with an approximate air permeability of 575 cfm, an approximate caliper of 0.048 inch, and a percent open area of approximately 0 percent.

As shown, the air laying forming station 30 includes a forming chamber 44 having end walls and side walls. Within the forming chamber 44 are a pair of material distributors which distribute fibers and/or other particles inside the forming chamber 44 across the width of the chamber. The material distributors can be, for instance, rotating cylindrical distributing screens.

Figure 3:
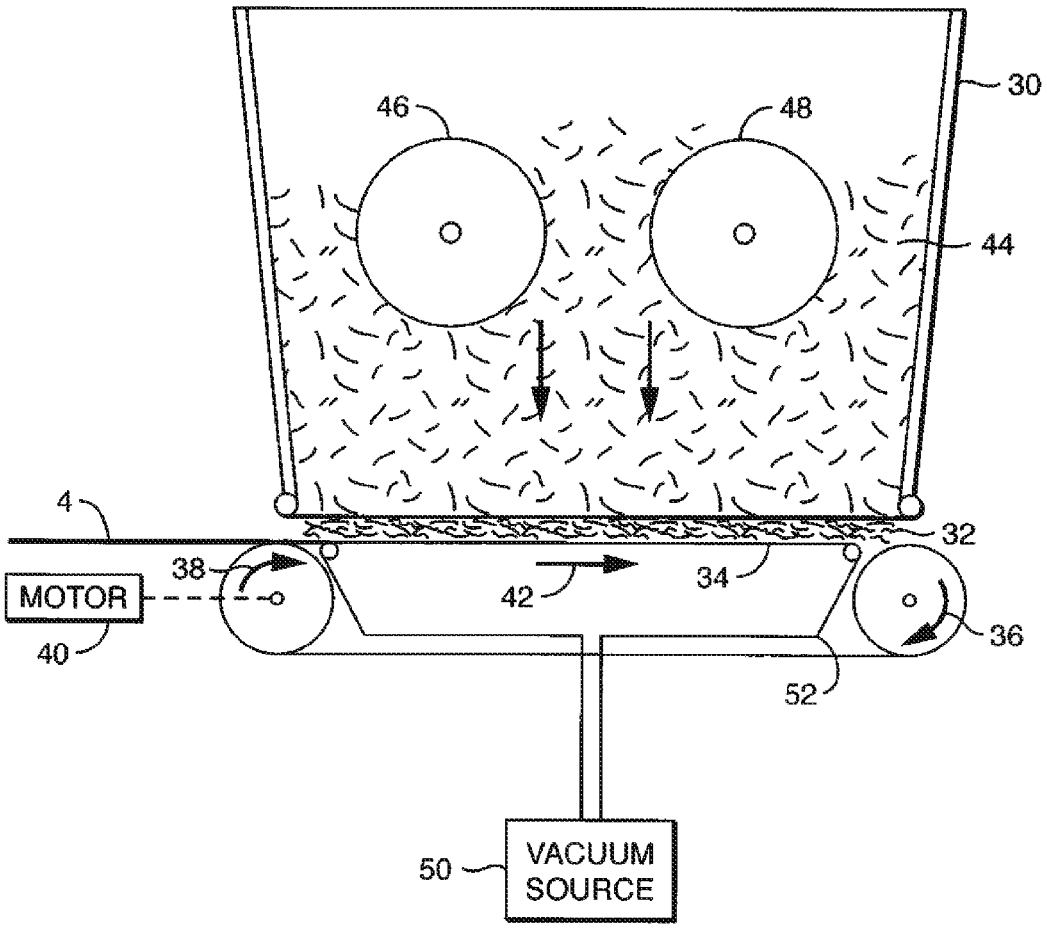
FIG. 3 is a schematic illustration of an air laying forming apparatus to form an exemplary second layer of the dispersible wet wipe.

In the embodiment shown in FIG. 3, a single forming chamber 44 is illustrated in association with the forming fabric 34. It is understood that more than one forming chamber can be included in the system. By including multiple forming chambers, layered webs can be formed in which each layer is made from the same or different materials.

Air laying forming stations, as shown in FIG. 3, are available commercially through Dan-Webforming International LTD. of Aarhus, Denmark. Other suitable air laying forming systems are also available from Oerlikon-Neumag of Horsens, Denmark. As described above, any suitable air laying forming system can be used to prepare the second layer of the wipe substrate described herein.

As shown in FIG. 3, below the air laying forming station 30 is a vacuum source 50, such as a conventional blower, for creating a selected pressure differential through the forming chamber 44 to draw the fibrous material against the first layer 4 residing on the forming fabric 34. If desired, a blower can also be incorporated into the forming chamber 44 for assisting in blowing the fibers down onto the forming fabric 34.

In one embodiment, the vacuum source 50 is a blower connected to a vacuum box 52, which is located below the forming chamber 44 and the forming fabric 34. The vacuum source 50 creates an airflow indicated by the arrows positioned within the forming chamber 44. Various seals can be used to increase the positive air pressure between the chamber and the forming fabric surface.

During operation, typically a fiber stock is fed to one or more defibrators (not shown) and fed to the material distributors. The material distributors distribute the fibers evenly throughout the forming chamber 44 as shown. Positive airflow created by the vacuum source 50, and possibly an additional blower, forces the fibers onto the first layer 4, thereby forming an air laid nonwoven web 32.

Figure 4:
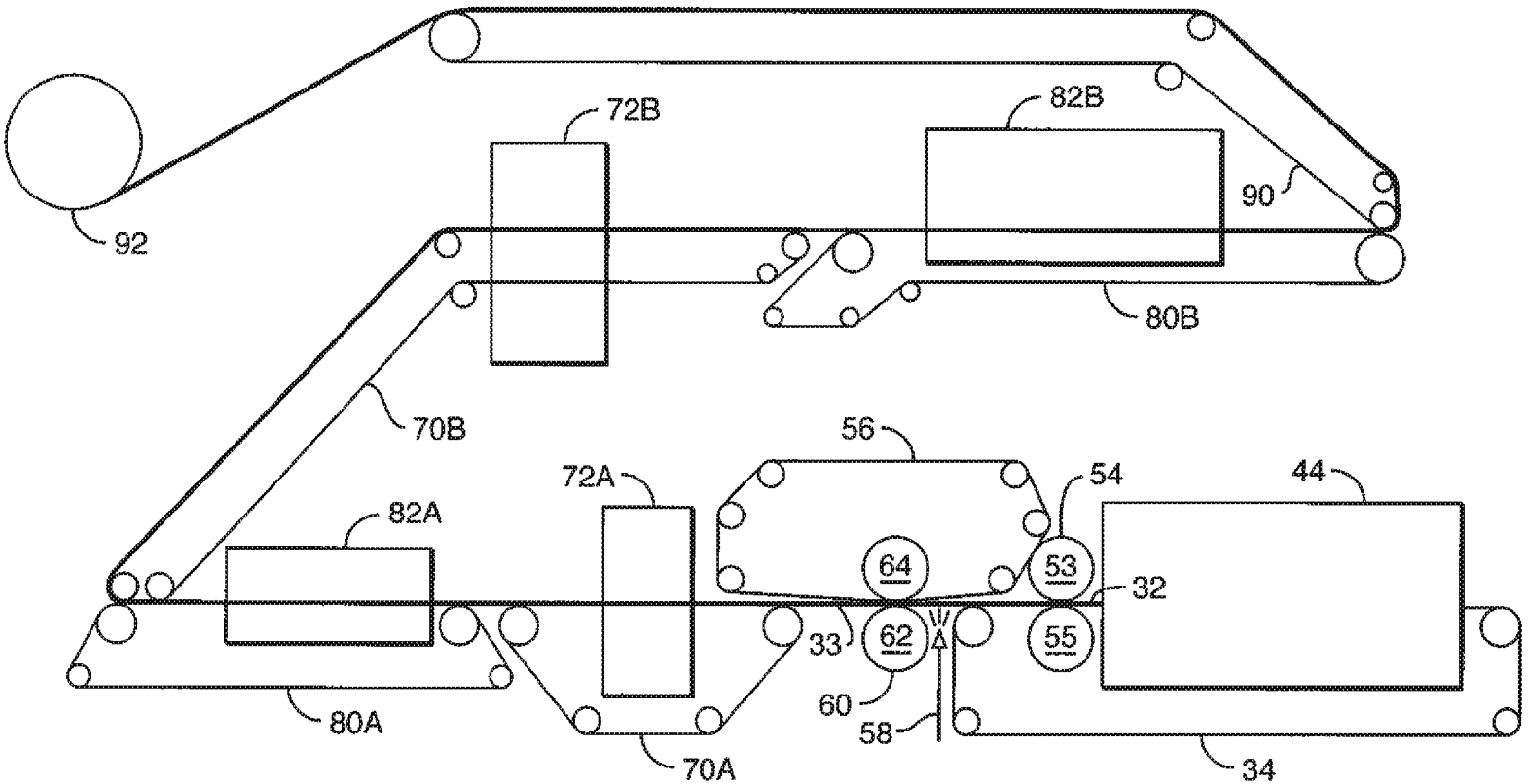
FIG. 4 is a schematic illustration of an exemplary process to form the wipe substrate.

In FIG. 4, a schematic diagram of an entire web forming system useful for making air laid substrates is shown. In this embodiment, the system includes an air laying forming chamber 44. As described above, the use of multiple forming chambers can serve to facilitate formation of the air laid web at a desired basis weight. Further, using multiple forming chambers can allow for the formation of layered webs. As shown, forming station 44 contributes to the formation of the dual layer substrate.

Air laid web 32, after exiting the forming chambers 44, is conveyed on the first layer of the webs to a compaction device 54. The compaction device 54 can be a pair of opposing rolls that define a nip through which the air laid web and forming fabric is passed. In one embodiment, the compaction device can comprise a steel roll 53 positioned above a covered roll 55, having a resilient roll covering for its outer surface. The compaction device increases the density of the air laid web to generate desired caliper/thickness of the air laid web. In general, the compaction device increases the density of the web over the entire surface area of the web as opposed to only creating localized high density areas.

The compaction rolls 53, 55 can be between about 10 to about 30 inches in diameter and can be optionally heated to further enhance their operation. For example, the steel roll can be heated to a temperature between about 150° F. to about 500° F. The compaction rolls can be operated at either a specified loading force or can be operated at a specified gap between the surfaces of each roll. Too much compaction will cause the web to lose bulk in the finished product, while too little compaction can cause runnability problems when transferring the air laid web to the next section in the process.

Alternatively, the compaction device 54 can be eliminated and the transfer fabric 56 and the forming fabric 34 can be brought together such that the air laid web 32 is transferred from the forming fabric to the transfer fabric. The transfer efficiency can be enhanced by use of suitable vacuum transfer boxes and/or pressured blow boxes as known in the art.

After transfer, the air laid web, while residing on the transfer fabric 56, is embossed by an embossing device 60. The embossing device can be an optionally heated engraved compaction roll 62 that is nipped with a backing roll 64 through which the air laid web 32 residing on the transfer fabric 56 is sent to form a textured air laid web 33.

After the air laid web 32 is transferred to the spray fabric, it is hydrated by a spray boom 58 with a liquid such as water. The percent moisture of the air laid web after hydration, based as a weight percent of the dry fibers of the web, can be between about 0.1 to about 5 percent, or between about 0.5 to about 4 percent, or between about 0.5 to about 2 percent. Too much moisture can cause the air laid web to adhere to the transfer fabric and not release for transfer to the next section of the process, while too little moisture can reduce the amount of texture generated in the web.

Next, the textured air laid web 33 is transferred to a spray fabric 70A and fed to a spray chamber 72A. Within the spray chamber 72A, a binder is applied to one side of the textured air laid web 33. The binder material can be deposited on the top side of the web using, for instance, spray nozzles. Under fabric vacuum may also be used to regulate and control penetration of the binder material into the web.

Once the binder material is applied to one side of the web, as shown in FIG. 4, the textured air laid web 33 is transferred to drying fabric 80A and fed to a drying apparatus 82A. In the drying apparatus 82A, the web is subjected to heat causing the binder material to dry and/or cure. When using an ethylene vinyl acetate copolymer binder material, the drying apparatus can be heated to a temperature of between about 120° C. to about 170° C.

From the drying apparatus 82A, the air laid web is then transferred to a second spray fabric 70B and fed to a second spray chamber 72B. In the spray chamber 72B, a second binder material is applied to the other untreated side of the air laid web. The first binder material and the second binder material can be different binder materials or the same binder material. The second binder material may be applied to the air laid web as described above with respect to the first binder material.

From the second spray chamber 72B, the textured air laid web is then transferred to a second drying fabric 80B and passed through a second drying apparatus 82B for drying and/or curing the second binder material. From the second drying apparatus 82B, the textured air laid web 33 is transferred to a return fabric 90 and then wound into a roll or reel 92. After winding, subsequent converting steps known to those of skill in the art can be used to transform the textured air laid substrate into a plurality of wet wipes. For example, the textured air laid substrate can be cut into individual wipes, the individual the wipes folded into a stack, the stack of wet wipes moistened with a cleaning solution, and then the stack of wet wipes can be placed into a dispenser.

The wipe substrate may be formed from a single layer or multiple layers. In the case of multiple layers, the layers are generally positioned in a juxtaposed or surface-to-surface relationship and all or a portion of the layers may be bound to adjacent layers. The fibrous material may also be formed from a plurality of separate fibrous materials wherein each of the separate fibrous materials may be formed from a different type of fiber. In those instances where the fibrous material includes multiple layers, the binder composition may be applied to the entire thickness of the fibrous material, or each individual layer may be separately treated and then combined with other layers in a juxtaposed relationship to form the finished fibrous material. Desirably, the wipe may be formed from a single layer or ply.

As described above, the wipe substrate includes a binder composition. In one embodiment the binder composition may include a triggerable polymer. In another embodiment, the binder composition may comprise a triggerable polymer and a cobinder polymer.

The amount of binder composition present in the wipe substrate may desirably range from about 1 to about 15 percent by weight based on the total weight of the wipe substrate. More desirably, the binder composition may comprise from about 1 to about 10 percent by weight based on the total weight of the wipe substrate. Most desirably, the binder composition may comprise from about 3 to about 8 percent by weight based on the total weight of the wipe substrate. The amount of the binder composition results in a multi-ply wipe substrate that has in-use integrity, but quickly disperses when soaked in tap water.

The composition of tap water can vary greatly depending on the water source. In the case of a dispersible wipe, the binder composition may preferably be capable of losing sufficient strength to allow the wet wipe to disperse in tap water covering the preponderance of the tap water composition range found throughout the United States (and throughout the world). Thus, it is important to evaluate the dispersibility of the binder composition in aqueous solutions which contain the major components in tap water and in a representative concentration range encompassing the majority of the tap water sources in the United States. The predominant inorganic ions typically found in drinking water are sodium, calcium, magnesium, bicarbonate, sulfate and chloride. Based on a recent study conducted by the American Water Works Association (AWWA) in 1996, the predominance of the U.S. municipal water systems (both ground water and surface water sources) surveyed have a total dissolved solids of inorganic components of about 500 ppm or less. This level of 500 ppm total dissolved solids also represents the secondary drinking water standard set by the U.S. Environmental Protection Agency. The average water hardness, which represents the calcium and magnesium concentrations in the tap water source, at this total dissolved solids level was approximately 250 ppm ($CaCO_3$ equivalent), which also encompasses the water hardness for the predominance of the municipal water systems surveyed by the AWWA. As defined by the United States Geological Survey (USGS), a water hardness of 250 ppm $CaCO_3$ equivalent would be considered "very hard" water. Similarly, the average bicarbonate concentration at 500 ppm total dissolved solids reported in the study was 12 ppm, which also encompasses the bicarbonate, or alkalinity, of the predominance of the municipal water systems surveyed. A past study by the USGS of the finished water supplies of 100 of the largest cities in the United States suggests that a sulfate level of about 100 ppm is sufficient to cover the majority of finished water supplies. Similarly, sodium and chloride levels of at least 50 ppm each should be sufficient to cover the majority of U.S. finished water supplies. Thus, binder compositions which are capable of losing strength in tap water compositions meeting these minimum requirements should also lose strength in tap water compositions of lower total dissolved solids with varied compositions of calcium, magnesium, bicarbonate, sulfate, sodium, and chloride. To ensure the dispersibility of the binder composition across the country (and throughout the whole world), the binder composition may desirably be soluble in water containing up to about 100 ppm total dissolved solids and a $CaCO_3$ equivalent hardness up to about 55 ppm. More desirably, the binder composition may be soluble in water containing up to about 300 ppm of total dissolved solids and a $CaCO_3$ equivalent hardness up to about 150 ppm. Even more desirably, the binder composition may be soluble in water containing up to about 500 ppm total dissolved solids and a $CaCO_3$ equivalent hardness up to about 250 ppm.

As previously disclosed, the binder composition may comprise the triggerable polymer and a cobinder. A variety of triggerable polymers may be used. One type of triggerable polymer is a dilution triggerable polymer. Examples of dilution triggerable polymers include ion-sensitive polymers, which may be employed in combination with a wetting composition in which the insolubilizing agent is a salt. Other dilution triggerable polymers may also be employed, wherein these dilution triggerable polymers are used in combination with wetting agents using a variety of insolubilizing agents, such as organic or polymeric compounds.

Although the triggerable polymer may be selected from a variety of polymers, including temperature sensitive polymers and pH-sensitive polymers, the triggerable polymer may preferably be the dilution triggerable polymer, comprising the ion-sensitive polymer. If the ion-sensitive polymer is derived from one or more monomers, where at least one contains an anionic functionality, the ion-sensitive polymer is referred to as an anionic ion-sensitive polymer. If the ion-sensitive polymer is derived from one or more monomers, where at least one contains a cationic functionality, the ion-sensitive polymer is referred to as a cationic ion-sensitive polymer. An exemplary anionic ion-sensitive polymer is described in U.S. Pat. No. 6,423,804, which is incorporated herein in its entirety by reference.

Examples of cationic ion-sensitive polymers are disclosed in the following U.S. Patent Application Publication Nos.: 2003/0026963, 2003/0027270, 2003/0032352, 2004/0030080, 2003/0055146, 2003/0022568, 2003/0045645, 2004/0058600, 2004/0058073, 2004/0063888, 2004/0055704, 2004/0058606, and 2004/0062791, all of which are incorporated herein by reference in their entirety, except that in the event of any inconsistent disclosure or definition from the present application, the disclosure or definition herein shall be deemed to prevail.

Desirably, the ion-sensitive polymer may be insoluble in the wetting composition, wherein the wetting composition comprises at least about 0.3 weight percent of an insolubilizing agent which may be comprised of one or more inorganic and/or organic salts containing monovalent and/or divalent ions. More desirably, the ion-sensitive polymer may be insoluble in the wetting composition, wherein the wetting composition comprises from about 0.3 to about 3.5 percent by weight of an insolubilizing agent which may be comprised of one or more inorganic and/or organic salts containing monovalent and/or divalent ions. Even more desirably, the ion-sensitive polymer may be insoluble in the wetting composition, wherein the wetting composition comprises from about 0.5 to about 3.5 percent by weight of an insolubilizing agent which comprises one or more inorganic and/or organic salts containing monovalent and/or divalent ions. Especially desirable, the ion-sensitive polymer may be insoluble in the wetting composition, wherein the wetting composition comprises from about 1 to about 3 percent by weight of an insolubilizing agent which comprises one or more inorganic and/or organic salts containing monovalent and/or divalent ions. Suitable monovalent ions include, but are not limited to, $Na^+$ ions, $K^+$ ions, $Li^+$ ions, $NH_4^+$ ions, low molecular weight quaternary ammonium compounds (e.g., those having fewer than 5 carbons on any side group), and a combination thereof. Suitable divalent ions include, but are not limited to, $Zn^{2+}$, $Ca^{2+}$ and $Mg^{2+}$. These monovalent and divalent ions may be derived from organic and inorganic salts including, but not limited to, NaCl, NaBr, KCl, $NH_4Cl$, $Na_2SO_4$, $ZnCl_2$, $CaCl_2$, $MgCl_2$, $MgSO_4$, and combinations thereof. Typically, alkali metal halides are the most desirable monovalent or divalent ions because of cost, purity, low toxicity and availability. A desirable salt is NaCl.

In a preferred embodiment, the ion-sensitive polymer may desirably provide the wipe substrate with sufficient in-use strength (typically >300 grams per linear inch) in combination with the wetting composition containing sodium chloride. These wipe substrates may be dispersible in tap water, desirably losing most of their wet strength (<200 grams per linear inch) in one hour or less.

In another preferred embodiment, the ion-sensitive polymer may comprise the cationic sensitive polymer, wherein the cationic sensitive polymer is a cationic polyacrylate that is the polymerization product of 96 mol % methyl acrylate and 4 mol % [2-(acryloyloxy)ethyl]trimethyl ammonium chloride.

As previously discussed, the binder composition may comprise the triggerable polymer and/or the cobinder. When the binder composition comprises the triggerable polymer and the cobinder, the triggerable polymer and the cobinder may preferably be compatible with each other in aqueous solutions to: 1) allow for facile application of the binder composition to the fibrous substrate in a continuous process and 2) prevent interference with the dispersibility of the binder composition. Therefore, if the triggerable polymer is the anionic ion-sensitive polymer, cobinders which are anionic, nonionic, or very weakly cationic may be preferred. If the triggerable polymer is the cationic ion-sensitive polymer, cobinders which are cationic, nonionic, or very weakly anionic may be added. Additionally, the cobinder desirably does not provide substantial cohesion to the wipe substrate by way of covalent bonds, such that it interferes with the dispersibility of the wipe substrate.

The presence of the cobinder may provide a number of desirable qualities. For example, the cobinder may serve to reduce the shear viscosity of the triggerable polymer, such that the binder composition has improved sprayability over the triggerable binder alone. By use of the term "sprayable" it is meant that these polymers may be applied to the fibrous material or substrate by spraying, allowing the uniform distribution of these polymers across the surface of the substrate and penetration of these polymers into the substrate. The cobinder may also reduce the stiffness of the wipe substrate compared to the stiffness of a wipe substrate to which only the triggerable polymer has been applied. Reduced stiffness may be achieved if the cobinder has a glass transition temperature, $T_g$, which is lower than the $T_g$ of the triggerable polymer. In addition, the cobinder may be less expensive than the triggerable polymer and by reducing the amount of triggerable polymer needed, may serve to reduce the cost of the binder composition. Thus, it may be desirable to use the highest amount of cobinder possible in the binder composition such that it does not jeopardize the dispersibility and in-use strength properties of the wet wipe. In a preferred embodiment, the cobinder replaces a portion of the triggerable polymer in the binder composition and permits a given strength level to be achieved, relative to a wet wipe having approximately the same tensile strength but containing only the triggerable polymer in the binder composition, to provide at least one of the following attributes: lower stiffness, better tactile properties (e.g., lubricity or smoothness) or reduced cost.

In one embodiment, the cobinder present in the binder composition, relative to the mass of the binder composition, may be about 10 percent or less, more desirably about 15 percent or less, more desirably 20 percent or less, more desirably 30 percent or less, or more desirably about 45 percent or less. Exemplary ranges of cobinder relative to the solid mass of the binder composition may include from about 1 to about 45 percent, from about 25 to about 35 percent, from about 1 to about 20 percent and from about 5 to about 25 percent.

The cobinder may be selected from a wide variety of polymers, as are known in the art. For example, the cobinder may be selected from the group consisting of poly(ethylene-vinyl acetate), poly(styrene-butadiene), poly(styrene-acrylic), a vinyl acrylic terpolymer, a polyester latex, an acrylic emulsion latex, poly(vinyl chloride), ethylene-vinyl chloride copolymer, a carboxylated vinyl acetate latex, and the like. A variety of additional exemplary cobinder polymers are discussed in U.S. Pat. No. 6,653,406 and U.S. Patent Application Publication No. 2003/00326963, which are both incorporated herein by reference in their entirety. Particularly preferred cobinders include VINNAPAS® EZ123 and VINNAPAS® 110.

To prepare the wipe substrates described herein, the binder composition may be applied to the fibrous material by any known process. Suitable processes for applying the binder composition include, but are not limited to, printing, spraying, electrostatic spraying, air atomization spraying, the use of metered press rolls, or impregnating. The amount of binder composition may be metered and distributed uniformly onto the fibrous material or may be non-uniformly distributed onto the fibrous material.

Once the binder composition is applied to the fibrous material, drying, if necessary, may be achieved by any conventional means. Once dry, the wipe substrate may exhibit improved tensile strength when compared to the tensile strength of the untreated wet-laid or dry-laid fibrous material, and yet should have the ability to rapidly "fall apart" or disintegrate when placed in tap water.

For ease of application to the fibrous substrate, the binder composition may be dissolved in water, or in a non-aqueous solvent, such as methanol, ethanol, acetone, or the like, with water being the preferred solvent. The amount of binder dissolved in the solvent may vary depending on the polymer used and the fabric application. Desirably, the binder solution contains less than about 18 percent by weight of binder composition solids. More desirably, the binder solution contains less than 16 percent by weight of binder composition solids.

A number of techniques may be employed to manufacture the wet wipes. In one embodiment, these techniques may include the following steps:

1. Providing the first layer of fibrous material having a density of between about 0.5 and 2.0 grams per cubic centimeter (e.g., an unbonded airlaid, a tissue web, a carded web, fluff pulp, etc.).
2. Depositing a second layer of fibrous material onto the first fibrous layer having a density of between about 0.05 and 0.15 grams per cubic centimeter (e.g., an airlaid nonwoven web).
3. Applying the binder composition to both sides of the fibrous material, typically in the form of a liquid, suspension, or foam to provide the wipe substrate.
4. The wipe substrate may be dried.
5. Applying a wetting composition to the wipe substrate to generate the wet wipe.
6. Placing the wet wipe in roll form or in a stack and packaging the product.

In one embodiment, the binder composition as applied in step 3 may comprise the triggerable polymer. In a further embodiment, the binder composition as applied in step 3 may comprise the triggerable polymer and the cobinder.

The finished wet wipes may be individually packaged, desirably in a folded condition, in a moisture proof envelope or packaged in containers holding any desired number of sheets in a water-tight package with a wetting composition applied to the wipe. Some example processes which can be used to manufacture folded wet wipes are described in U.S. Pat. Nos. 5,540,332 and 6,905,748, which are incorporated by reference herein. The finished wipes may also be packaged as a roll of separable sheets in a moisture-proof container holding any desired number of sheets on the roll with a wetting composition applied to the wipes. The roll can be coreless and either hollow or solid. Coreless rolls, including rolls with a hollow center or without a solid center, can be produced with known coreless roll winders, including those of SRP Industry, Inc. of San Jose, Calif.; Shimizu Manufacturing of Japan, and the devices disclosed in U.S. Pat. No. 4,667,890. U.S. Pat. No. 6,651,924 also provides examples of a process for producing coreless rolls of wet wipes.

In addition to the wipe substrate, wet wipes also contain a wetting composition described herein. The liquid wetting composition can be any liquid, which can be absorbed into the wet wipe basesheet and may include any suitable components, which provide the desired wiping properties. For example, the components may include water, emollients, surfactants, fragrances, preservatives, organic or inorganic acids, chelating agents, pH buffers, or combinations thereof, as are well known to those skilled in the art. Further, the liquid may also contain lotions, medicaments, and/or antimicrobials.

The wetting composition may desirably be incorporated into the wipe in an add-on amount of from about 10 to about 600 percent by weight of the substrate, more desirably from about 50 to about 500 percent by weight of the substrate, even more desirably from about 100 to about 500 percent by weight of the substrate, and especially more desirably from about 200 to about 300 percent by weight of the substrate.

In the case of a dispersible, wipe, the wetting composition for use in combination with the wipe substrate may desirably comprise an aqueous composition containing the insolubilizing agent that maintains the coherency of the binder composition and thus the in-use strength of the wet wipe until the insolubilizing agent is diluted with tap water. Thus the wetting composition may contribute to the triggerable property of the triggerable polymer and concomitantly the binder composition.

The insolubilizing agent in the wetting composition can be a salt, such as those previously disclosed for use with the ion-sensitive polymer, a blend of salts having both monovalent and multivalent ions, or any other compound, which provides in-use and storage strength to the binder composition and may be diluted in water to permit dispersion of the wet wipe as the binder composition transitions to a weaker state. The wetting composition may desirably contain more than about 0.3 weight percent of an insolubilizing agent based on the total weight of the wetting composition. The wetting composition may desirably contain from about 0.3 to about 10 weight percent of an insolubilizing agent based on the total weight of the wetting composition. More desirably, the wetting composition may contain from about 0.5 to about 5 weight percent of an insolubilizing agent based on the total weight of the wetting composition. More desirably, the wetting composition may contain from about 1 to about 4 weight percent of an insolubilizing agent based on the total weight of the wetting composition. Even more desirably, the wetting composition may contain from about 1 to about 2 weight percent of an insolubilizing agent based on the total weight of the wetting composition.

The wetting composition may desirably be compatible with the triggerable polymer, the cobinder polymer, and any other components of the binder composition. In addition, the wetting composition desirably contributes to the ability of the wet wipes to maintain coherency during use, storage and/or dispensing, while still providing dispersibility in tap water.

In one example, the wetting compositions may contain water. The wetting compositions can suitably contain water in an amount of from about 0.1 to about 99.9 percent by weight of the composition, more typically from about 40 to about 99 percent by weight of the composition, and more preferably from about 60 to about 99.9 percent by weight of the composition. For instance, where the composition is used in connection with a wet wipe, the composition can suitably contain water in an amount of from about 75 to about 99.9 percent by weight of the composition.

The wetting compositions may further contain additional agents that impart a beneficial effect on skin or hair and/or further act to improve the aesthetic feel of the compositions and wipes described herein. Examples of suitable skin benefit agents include emollients, sterols or sterol derivatives, natural and synthetic fats or oils, viscosity enhancers, rheology modifiers, polyols, surfactants, alcohols, esters, silicones, clays, starch, cellulose, particulates, moisturizers, film formers, slip modifiers, surface modifiers, skin protectants, humectants, sunscreens, and the like.

Thus, in one example, the wetting compositions may further optionally include one or more emollients, which typically act to soften, soothe, and otherwise lubricate and/or moisturize the skin. Suitable emollients that can be incorporated into the compositions include oils such as petrolatum based oils, petrolatum, mineral oils, alkyl dimethicones, alkyl methicones, alkyldimethicone copolyols, phenyl silicones, alkyl trimethylsilanes, dimethicone, dimethicone crosspolymers, cyclomethicone, lanolin and its derivatives, glycerol esters and derivatives, propylene glycol esters and derivatives, alkoxylated carboxylic acids, alkoxylated alcohols, and combinations thereof.

Ethers such as eucalyptol, cetearyl glucoside, dimethyl isosorbic polyglyceryl-3 cetyl ether, polyglyceryl-3 decyltetradecanol, propylene glycol myristyl ether, and combinations thereof, can also suitably be used as emollients.

In addition, the wetting composition may include an emollient in an amount of from about 0.01 to about 20 percent by weight of the composition, more desirably from about 0.05 to about 10 percent by weight of the composition, and more typically from about 0.1 to about 5 percent by weight of the composition.

One or more viscosity enhancers may also be added to the wetting composition to increase the viscosity, to help stabilize the composition thereby reducing migration of the composition and improving transfer to the skin. Suitable viscosity enhancers include polyolefin resins, lipophilic/oil thickeners, polyethylene, silica, silica silylate, silica methyl silylate, colloidal silicone dioxide, cetyl hydroxy ethyl cellulose, other organically modified celluloses, PVP/decane copolymer, PVM/MA decadiene crosspolymer, PVP/eicosene copolymer, PVP/hexadecane copolymer, clays, starches, gums, water-soluble acrylates, carbomers, acrylate based thickeners, surfactant thickeners, and combinations thereof.

The wetting composition may desirably include one or more viscosity enhancers in an amount of from about 0.01 to about 25 percent by weight of the composition, more desirably from about 0.05 to about 10 percent by weight of the composition, and even more desirably from about 0.1 to about 5 percent by weight of the composition.

The compositions of the disclosure may optionally further contain humectants. Examples of suitable humectants include glycerin, glycerin derivatives, sodium hyaluronate, betaine, amino acids, glycosaminoglycans, honey, sorbitol, glycols, polyols, sugars, hydrogenated starch hydrolysates, salts of PCA, lactic acid, lactates, and urea. A particularly preferred humectant is glycerin. The composition of the present disclosure may suitably include one or more humectants in an amount of from about 0.05 to about 25 percent by weight of the composition.

The compositions of the disclosure may optionally further contain film formers. Examples of suitable film formers include lanolin derivatives (e.g., acetylated lanolins), superfatted oils, cyclomethicone, cyclopentasiloxane, dimethicone, synthetic and biological polymers, proteins, quaternary ammonium materials, starches, gums, cellulosics, polysaccharides, albumen, acrylates derivatives, IPDI derivatives, and the like. The composition of the present disclosure may suitably include one or more film formers in an amount of from about 0.01 to about 20 percent by weight of the composition.

The wetting compositions may also further contain skin protectants. Examples of suitable skin protectants include ingredients referenced in SP monograph (21 CFR §347). Suitable skin protectants and amounts include those set forth in SP monograph, Subpart B—Active Ingredients §347.10: (a) Allantoin, 0.5 to 2%, (b) Aluminum hydroxide gel, 0.15 to 5%, (c) Calamine, 1 to 25%, (d) Cocoa butter, 50 to 100%, (e) Cod liver oil, 5 to 13.56%, in accordance with §347.20(a)(1) or (a)(2), provided the product is labeled so that the quantity used in a 24-hour period does not exceed 10,000 U.S.P. Units vitamin A and 400 U.S.P. Units cholecalciferol, (f) Colloidal oatmeal, 0.007% minimum; 0.003% minimum in combination with mineral oil in accordance with §347.20(a)(4), (g) Dimethicone, 1 to 30%, (h) Glycerin, 20 to 45%, (i) Hard fat, 50 to 100%, (j) Kaolin, 4 to 20%, (k) Lanolin, 12.5 to 50%, (l) Mineral oil, 50 to 100%; 30 to 35% in combination with colloidal oatmeal in accordance with §347.20(a)(4), (m) Petrolatum, 30 to 100%, (o) Sodium bicarbonate, (q) Topical starch, 10 to 98%, (r) White petrolatum, 30 to 100%, (s) Zinc acetate, 0.1 to 2%, (t) Zinc carbonate, 0.2 to 2%, (u) Zinc oxide, 1 to 25%.

The wetting compositions may also further contain quaternary ammonium materials. Examples of suitable quaternary ammonium materials include polyquaternium-7, polyquaternium-10, benzalkonium chloride, behentrimonium methosulfate, cetrimonium chloride, cocamidopropyl pg-dimonium chloride, guar hydroxypropyltrimonium chloride, isostearamidopropyl morpholine lactate, polyquaternium-33, polyquaternium-60, polyquaternium-79, quaternium-18 hectorite, quaternium-79 hydrolyzed silk, quaternium-79 hydrolyzed soy protein, rapeseed amidopropyl ethyldimonium ethosulfate, silicone quaternium-7, stearalkonium chloride, palmitamidopropyltrimonium chloride, butylglucosides, hydroxypropyltrimonium chloride, laurdimoniumhydroxypropyl decylglucosides chloride, and the like. The composition of the present disclosure may suitably include one or more quaternary materials in an amount of from about 0.01 to about 20 percent by weight of the composition.

The wetting compositions may optionally further contain surfactants. Examples of suitable additional surfactants include, for example, anionic surfactants, cationic surfactants, amphoteric surfactants, zwitterionic surfactants, nonionic surfactants, and combinations thereof. Specific examples of suitable surfactants are known in the art and include those suitable for incorporation into wetting compositions and wipes. The composition of the present disclosure may suitably include one or more surfactants in an amount of from about 0.01 to about 20 percent by weight of the composition.

In addition to nonionic surfactants, the cleanser may also contain other types of surfactants. For instance, in some embodiments, amphoteric surfactants, such as zwitterionic surfactants, may also be used. For instance, one class of amphoteric surfactants that may be used in the present disclosure are derivatives of secondary and tertiary amines having aliphatic radicals that are straight chain or branched, wherein one of the aliphatic substituents contains from about 8 to 18 carbon atoms and at least one of the aliphatic substituents contains an anionic water-solubilizing group, such as a carboxy, sulfonate, or sulfate group. Some examples of amphoteric surfactants include, but are not limited to, sodium 3-(dodecylamino)propionate, sodium 3-(dodecylamino)-propane-1-sulfonate, sodium 2-(dodecylamino)ethyl sulfate, sodium 2-(dimethylamino)octadecanoate, disodium 3-(N-carboxymethyl-dodecylamino)propane-1-sulfonate, disodium octadecyliminodiacetate, sodium 1-carboxymethyl-2-undecylimidazole, and sodium N,N-bis(2-hydroxyethyl)-2-sulfato-3-dodecoxypropylamine.

Additional classes of suitable amphoteric surfactants include phosphobetaines and the phosphitaines. For instance, some examples of such amphoteric surfactants include, but are not limited to, sodium coconut N-methyl taurate, sodium oleyl N-methyl taurate, sodium tall oil acid N-methyl taurate, sodium palmitoyl N-methyl taurate, cocodimethylcarboxymethylbetaine, lauryldimethylcarboxymethylbetaine, lauryldimethylcarboxyethylbetaine, cetyldimethylcarboxymethylbetaine, lauryl-bis-(2-hydroxyethyl) carboxymethylbetaine, oleyldimethylgammacarboxypropylbetaine, lauryl-bis-(2-hydroxypropyl)-carboxyethylbetaine, cocoamidodimethylpropylsultaine, stearylamidodimethylpropylsultaine, laurylamido-bis-(2-hydroxyethyl)propylsultaine, di-sodium oleamide PEG-2 sulfosuccinate, TEA oleamido PEG-2 sulfosuccinate, disodium oleamide MEA sulfosuccinate, disodium oleamide MIPA sulfosuccinate, disodium ricinoleamide MEA sulfosuccinate, disodium undecylenamide MEA sulfosuccinate, disodium lauryl sulfosuccinate, disodium wheat germamido MEA sulfosuccinate, disodium wheat germamido PEG-2 sulfosuccinate, disodium isostearamideo MEA sulfosuccinate, cocoamphoglycinate, cocoamphocarboxyglycinate, lauroamphoglycinate, lauroamphocarboxyglycinate, capryloamphocarboxyglycinate, cocoamphopropionate, cocoamphocarboxypropionate, lauroamphocarboxypropionate, capryloamphocarboxypropionate, dihydroxyethyl tallow glycinate, cocoamido disodium 3-hydroxypropyl phosphobetaine, lauric myristic amido disodium 3-hydroxypropyl phosphobetaine, lauric myristic amido glyceryl phosphobetaine, lauric myristic amido carboxy disodium 3-hydroxypropyl phosphobetaine, cocoamido propyl monosodium phosphitaine, cocamidopropyl betaine, lauric myristic amido propyl monosodium phosphitaine, and mixtures thereof.

In certain instances, it may also be desired to utilize one or more anionic surfactants within the cleansers. Suitable anionic surfactants include, but are not limited to, alkyl sulfates, alkyl ether sulfates, alkyl ether sulfonates, sulfate esters of an alkylphenoxy polyoxyethylene ethanol, alpha-olefin sulfonates, beta-alkoxy alkane sulfonates, alkylauryl sulfonates, alkyl monoglyceride sulfates, alkyl monoglyceride sulfonates, alkyl carbonates, alkyl ether carboxylates, fatty acid salts, sulfosuccinates, sarcosinates, octoxynol or nonoxynol phosphates, taurates, fatty taurides, fatty acid amide polyoxyethylene sulfates, isothionates, or mixtures thereof.

Particular examples of some suitable anionic surfactants include, but are not limited to, $C_{8-18}$ alkyl sulfates, $C_{8-18}$ fatty acid salts, $C_{8-18}$ alkyl ether sulfates having one or two moles of ethoxylation, $C_{8-18}$ alkyl sarcosinates, $C_{8-18}$ sulfoacetates, $C_{8-18}$ sulfosuccinates, $C_{8-18}$ alkyl diphenyl oxide disulfonates, $C_{8-18}$ alkyl carbonates, $C_{8-18}$ alpha-olefin sulfonates, methyl ester sulfonates, and blends thereof. The $C_{8-18}$ alkyl group can be straight chain (e.g., lauryl) or branched (e.g., 2-ethylhexyl). The cation of the anionic surfactant can be an alkali metal (e.g., sodium or potassium), ammonium, $C_{1-4}$ alkylammonium (e.g., mono-, di-, tri-), or $C_{1-3}$ alkanolammonium (e.g., mono-, di-, tri-).

Specific examples of such anionic surfactants include, but are not limited to, lauryl sulfates, octyl sulfates, 2-ethylhexyl sulfates, decyl sulfates, tridecyl sulfates, cocoates, lauryl sarcosinates, lauryl sulfosuccinates, linear $C_{10}$ diphenyl oxide disulfonates, lauryl sulfosuccinates, lauryl ether sulfates (1 and 2 moles ethylene oxide), myristyl sulfates, oleates, stearates, tallates, ricinoleates, cetyl sulfates, and similar surfactants.

Cationic surfactants, such as cetylpyridinium chloride and methyl-benzethonium chloride, may also be utilized.

The wetting compositions may also further contain additional emulsifiers. As mentioned above, the natural fatty acids, esters and alcohols and their derivatives, and combinations thereof, may act as emulsifiers in the composition. Optionally, the composition may contain an additional emulsifier other than the natural fatty acids, esters and alcohols and their derivatives, and combinations thereof. Examples of suitable emulsifiers include nonionic emulsifiers such as polysorbate 20, polysorbate 80, anionic emulsifiers such as DEA phosphate, cationic emulsifiers such as behentrimonium methosulfate, and the like. The composition of the present disclosure may suitably include one or more additional emulsifiers in an amount of from about 0.01 to about 10 percent by weight of the composition.

For example, nonionic surfactants may be used as an emulsifier. Nonionic surfactants typically have a hydrophobic base, such as a long chain alkyl group or an alkylated aryl group, and a hydrophilic chain comprising a certain number (e.g., 1 to about 30) of ethoxy and/or propoxy moieties. Examples of some classes of nonionic surfactants that can be used include, but are not limited to, ethoxylated alkylphenols, ethoxylated and propoxylated fatty alcohols, polyethylene glycol ethers of methyl glucose, polyethylene glycol ethers of sorbitol, ethylene oxide-propylene oxide block copolymers, ethoxylated esters of fatty ($C_{8-18}$) acids, condensation products of ethylene oxide with long chain amines or amides, condensation products of ethylene oxide with alcohols, and mixtures thereof.

Various specific examples of suitable nonionic surfactants include, but are not limited to, methyl gluceth-10, PEG-20 methyl glucose distearate, PEG-20 methyl glucose sesquistearate, $C_{11-15}$ pareth-20, ceteth-8, ceteth-12, dodoxynol-12, laureth-15, PEG-20 castor oil, polysorbate 20, steareth-20, polyoxyethylene-10 cetyl ether, polyoxyethylene-10 stearyl ether, polyoxyethylene-20 cetyl ether, polyoxyethylene-10 oleyl ether, polyoxyethylene-20 oleyl ether, an ethoxylated nonylphenol, ethoxylated octylphenol, ethoxylated dodecylphenol, ethoxylated fatty ($C_{8-22}$) alcohol, including 3 to 20 ethylene oxide moieties, polyoxyethylene-20 isohexadecyl ether, polyoxyethylene-23 glycerol laurate, PEG 80 sorbitan laurate, polyoxy-ethylene-20 glyceryl stearate, PPG-10 methyl glucose ether, PPG-20 methyl glucose ether, polyoxyethylene-20 sorbitan monoesters, polyoxyethylene-80 castor oil, polyoxyethylene-15 tridecyl ether, polyoxy-ethylene-6 tridecyl ether, laureth-2, laureth-3, laureth-4, PEG-3 castor oil, PEG 600 dioleate, PEG 400 dioleate, and mixtures thereof.

The wetting compositions may also further contain preservatives. Suitable preservatives for use in the present compositions may include, for instance, Kathon CG, which is a mixture of methylchloroisothiazolinone and methylisothiazolinone available from Rohm & Haas of Philadelphia, Pa.;

Neolone 950®, which is methylisothiazolinone available from Rohm & Haas of Philadelphia, Pa.; DMDM hydantoin (e.g., Glydant Plus available from Lonza, Inc. of Fair Lawn, N.J.); iodopropynyl butylcarbamate; benzoic esters (parabens), such as methylparaben, propylparaben, butylparaben, ethylparaben, isopropylparaben, isobutylparaben, benzylparaben, sodium methylparaben, and sodium propylparaben; 2-bromo-2-nitropropane-1,3-diol; benzoic acid; imidazolidinyl urea; diazolidinyl urea; and the like. Still other preservatives may include ethylhexylglycerin, phenoxyethanol caprylyl glycol, a blend of 1,2-hexanediol, caprylyl glycol and tropolone, and a blend of phenoxyethanol and tropolone.

The wetting compositions may additionally include adjunct components conventionally found in pharmaceutical compositions in their art-established fashion and at their art-established levels. For example, the compositions may contain additional compatible pharmaceutically active materials for combination therapy, such as antimicrobials, antioxidants, anti-parasitic agents, antipruritics, antifungals, antiseptic actives, biological actives, astringents, keratolytic actives, local anesthetics, anti-stinging agents, anti-reddening agents, skin soothing agents, and combinations thereof. Other suitable additives that may be included in the compositions of the present disclosure include colorants, deodorants, fragrances, perfumes, emulsifiers, anti-foaming agents, lubricants, natural moisturizing agents, skin conditioning agents, skin protectants and other skin benefit agents (e.g., extracts such as aloe vera and anti-aging agents such as peptides), solvents, solubilizing agents, suspending agents, wetting agents, humectants, pH adjusters, buffering agents, dyes and/or pigments, and combinations thereof.

The wet wipes, as disclosed herein, do not require organic solvents to maintain in-use strength, and the wetting composition may be substantially free of organic solvents. Organic solvents may produce a greasy after-feel and cause irritation in higher amounts. However, small amounts of organic solvents may be included in the wetting composition for different purposes other than maintaining in-use wet strength. In one embodiment, small amounts of organic solvents (less than about 1 percent) may be utilized as fragrance or preservative solubilizers to improve process and shelf stability of the wetting composition. The wetting composition may desirably contain less than about 5 weight percent of organic solvents, such as propylene glycol and other glycols, polyhydroxy alcohols, and the like, based on the total weight of the wetting composition. More desirably, the wetting composition may contain less than about 3 weight percent of organic solvents. Even more desirably, the wetting composition may contain less than about 1 weight percent of organic solvents.

The wet wipes, as disclosed herein, desirably may be made to have sufficient tensile strength, sheet-to-sheet adhesion, calculated per layer stack thickness and flexibility.

The wet wipes may be prepared using a wipe substrate with a fibrous material and a binder composition forming a nonwoven airlaid web. These wet wipes made with the wipe substrate may also be made to be usable without breaking or tearing, to be consumer acceptable, and provide problem-free disposal once disposed in a household sanitation system. The wet wipes may also be prepared using a coform substrate as described above.

The wet wipe formed with a wipe substrate desirably may have a machine direction tensile strength ranging from at least about 300 to about 1000 grams per linear inch. More desirably, the wet wipe may have a machine direction tensile strength ranging from at least about 300 to about 800 grams per linear inch. Even more desirably, the wet wipe may have a machine direction tensile strength ranging from at least about 300 to about 600 grams per linear inch. Most desirably, the wet wipe may have a machine direction tensile strength ranging from at least about 350 to about 550 grams per linear inch.

The wet wipe may be configured to provide all desired physical properties by use of a single or multi-ply wet wipe product, in which two or more plies of wipe substrate are joined together by methods known in the art to form a multi-ply wipe.

As mentioned previously, the wet wipes formed from the wipe substrate, may be sufficiently dispersible so that they lose enough strength to break apart in tap water under conditions typically experienced in household or municipal sanitation systems. Also mentioned previously, the tap water used for measuring dispersibility should encompass the concentration range of the majority of the components typically found in the tap water compositions that the wet wipe would encounter upon disposal. Previous methods for measuring dispersibility of the wipe substrates, whether dry or premoistened, have commonly relied on systems in which the material was exposed to shear while in water, such as measuring the time for a material to break up while being agitated by a mechanical mixer. Constant exposure to such relatively high, uncontrolled shear gradients offers an unrealistic and overly optimistic test for products designed to be flushed in a toilet, where the level of shear is extremely weak or brief. Shear rates may be negligible, for example once the material enters a septic tank. Thus, for a realistic appraisal of wet wipe dispersibility, the test methods should simulate the relatively low shear rates the products will experience once they have been flushed in the toilet.

A static soak test, for example, should illustrate the dispersibility of the wet wipe after it is fully submerged with water from the toilet and where it experiences negligible shear, such as in a septic tank. Desirably, the wet wipe may have less than about 200 grams per linear inch of tensile strength after one hour when soaked in tap water.

The wet wipe preferably maintains its desired characteristics over the time periods involved in warehousing, transportation, retail display and storage by the consumer. In one embodiment, shelf life may range from two months to two years.

The wet wipes, as disclosed herein, are illustrated by the following examples, which are not to be construed in any way as imposing limitations upon the scope thereof. On the contrary, it is to be clearly understood various other embodiments, modifications, and equivalents thereof, which, after reading the description herein, may suggest themselves to those skilled in the art without departing from the spirit and/or the scope of the appended claims.

Test Methods

Wet Wipe Tensile Strength Measurements

For purposes herein, tensile strength may be measured using a Constant Rate of Elongation (CRE) tensile tester using a 1-inch jaw width (sample width), a test span of 3 inches (gauge length), and a rate of jaw separation of 25.4 centimeters per minute after maintaining the sample at the ambient conditions of 23±2° C. and 50±5% relative humidity for four hours before testing the sample at the same ambient conditions. The wet wipes are cut into 1-inch wide strips cut from the center of the wipes in the specified machine direction (MD) or cross-machine direction (CD) orientation using a JDC Precision Sample Cutter (Thwing-Albert Instrument Company, Philadelphia, Pa., Model No. JDC 3-10, Serial No. 37333). The "MD tensile strength" is the peak load in grams-force per inch of sample width when a sample is pulled to rupture in the machine direction. The "CD tensile strength" is the peak load in grams-force per inch of sample width when a sample is pulled to rupture in the cross direction.

The instrument used for measuring tensile strength is an MTS Systems Sinergie 200 model. The data acquisition software is MTS TestWorks® for Windows Ver. 4.0 commercially available from MTS Systems Corp., Eden Prairie, Minn. The load cell is an MTS 50 Newton maximum load cell. The gauge length between jaws is 3±0.04 inches. The top and bottom jaws are operated using pneumatic-action with maximum 60 P.S.I. The break sensitivity is set at 40 percent. The data acquisition rate is set at 100 Hz (i.e., 100 samples per second). The sample is placed in the jaws of the instrument, centered both vertically and horizontally. The test is then started and ends when the force drops by 40 percent of peak. The peak load expressed in grams-force is recorded as the "MD tensile strength" of the specimen. At least twelve representative specimens are tested for each product and its average peak load is determined. As used herein, the "geometric mean tensile strength" (GMT) is the square root of the product of the dry machine direction tensile strength multiplied by the dry cross-machine direction tensile strength and is expressed as grams per inch of sample width. All of these values are for in-use tensile strength measurements.

To provide post-use tensile strength measurements, the samples are submerged in tap water for a time period of one hour and then measured for tensile strength.

Basis Weight

The dry basis weight of the basesheet material forming the wet wipes can be obtained using the ASTM active standard D646-96(2001), Standard Test Method for Grammage of Paper and Paperboard (Mass per Unit Area), or an equivalent method.

Slosh Box Test

This method uses a bench-scaled apparatus to evaluate the breakup or dispersibility of flushable consumer products as they travel through the wastewater collection system. In this test method, a clear plastic tank is loaded with a product and tap water or raw wastewater. The container is then moved up and down by a cam system at a specified rotational speed to simulate the movement of wastewater in the collection system. The initial breakup point and the time for dispersion of the product into pieces measuring 1 in×1 in (25 mm×25 mm) are recorded in the laboratory notebook. This 1 in×1 in (25 mm×25 mm) size is a parameter that is used because it reduces the potential of product recognition. The testing can be extended until the product is fully dispersed. The various components of the product are then screened and weighed to determine the rate and level of disintegration.

Testing Parameters:

The slosh box water transport simulator consists of a transparent plastic tank that is mounted on an oscillating platform with speed and holding time controller. The angle of incline produced by the cam system produces a water motion equivalent to 60 cm/s (2 ft/s), which is the minimum design standard for wastewater flow rate in an enclosed collection system. The rate of oscillation is controlled mechanically by the rotation of a cam and level system and should be measured periodically throughout the test. This cycle mimics the normal back-and forth movement of wastewater as it flows through a sewer pipe.

Test Initiation:

Room temperature tap water (softened and/or non-softened) or raw wastewater (2000 mL) is placed in the plastic container/tank. The timer is set for six hours (or longer) and cycle speed is set for 26 rpm. The pre-weighed product is placed in the tank and observed as it undergoes the agitation period. For toilet tissue, add a number of sheets that range in weight from 1 to 3 grams. All other products may be added whole with no more than one article per test. A minimum of one gram of test product is recommended so that adequate loss measurements can be made. The time to first breakup and full dispersion are recorded in the laboratory notebook. Note: For pre-moistened products it is recommended to flush them down the toilet and drain line apparatus prior to putting them into the slosh box apparatus or rinse them by some other means. Other pre-rinsing techniques should be described in the study records.

Test Termination:

The test is terminated when the product reaches a dispersion point of no piece larger than 1 in×1 in (25 mm×25 mm) square in size or at the designated destructive sampling points. The amount of time to reach this point is measured.

Fiber Length

Fiber length may be tested by TAPPI test method T 271 om-02 entitled *Fiber Length of Pulp and Paper by Automated Optical Analyzer Using Polarized Light*. The test method is an automated method by which the fiber length distributions of pulp and paper in the range of 0.1 to 7.2 mm can be measured using light polarizing optics. Fiber length is measured and calculated as a length weighted mean fiber length according to the test method.

Stiffness

The stiffness as used herein is a measure of a wipe sample as it is deformed downward into a hole. For the test, the wipe sample is modeled as an infinite plate with thickness t that resides on a flat surface where it is centered over a hole with radius R. A central force applied to the wipe sample directly over the center of the hole deflects the wipe sample down into the hole by a distance w when loaded in the center by a Force F. For a linear elastic material the deflection may be predicted by:

$$w = \frac{3F}{4\pi E t^3}(1-\nu)(3+\nu)R^2$$

where E is the effective linear elastic modulus, v is the Poisson's ratio, R is the radius of the hole, and t is the thickness of the wipe sample, taken as the caliper in millimeters measured under a load of about 0.05 psi, applied by a 3-inch diameter Plexiglas platen, with the thickness measured with a Sony U60A Digital Indicator. Taking Poisson's ratio as 0.1 (the solution is not highly sensitive to this parameter, so the inaccuracy due to the assumed value is likely to be minor), we can rewrite the previous equation for w to estimate the effective modulus as a function of the flexibility test results:

$$E \approx \frac{2R^2}{3t^3}\frac{F}{w}$$

The test results are carried out using an MTS Alliance RT/1 testing machine (MTS Systems Corp. Eden Prairie, Minn.) with a 100 N load cell. As a wipe sample at least 2.5-inches square sits centered over a hole of radius 17 mm on a support plate, a blunt probe of 3.15 mm radius descends at a speed of 2.54 mm/min. When the probe tip descends to 1 mm below the plane of the support plate, the test is terminated. The maximum slope in grams of force/mm over any 0.5 mm span during the test is recorded (this maximum slope generally occurs at the end of the stroke). The load cell monitors the applied force and the position of the probe tip relative to the plane of the support plate is also monitored. The peak load is recorded, and E is estimated using the above equation.

The bending stiffness per unit width may then be calculated as:

$$S = \frac{Et^3}{12}$$

The stiffness and modulus measured are believed to provide useful information about the ability of a material to bend and flex when used on a flexible absorbent article worn on the body, or may indicate the ability of a material to be bent easily during attachment and removal (e.g., peeling off) when used in an attachment system.

Caliper

The caliper as used herein is the thickness of a single sheet, but measured as the thickness of a stack of ten sheets and dividing the ten sheet thickness by ten, where each sheet within the stack is placed with the same side up. Caliper is expressed in microns. It is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is a Bulk Micrometer (TMI Model 49-72-00, Amityville, N.Y.) having an anvil diameter of 4 1/16 inches (103.2 millimeters) and an anvil pressure of 220 grams/square inch (3.3 g kiloPascals). After the Caliper is measured, the same ten sheets in the stack are used to determine the average basis weight of the sheets.

Density

The density of the tissue is calculated by dividing its basis weight by its caliper.

Cup Crush

As used herein, the term "cup crush" refers to one measure of the softness of a nonwoven fabric sheet that is determined according to the "cup crush" test. The test is generally performed as discussed in detail in U.S. patent application Ser. No. 09/751,329 entitled, "Composite Material With Cloth-Like Feel" filed Dec. 29, 2000, hereby incorporated by reference. The cup crush test evaluates fabric stiffness by measuring the peak load (also called the "cup crush load" or just "cup crush") required for a 4.5 cm diameter hemispherically shaped foot to crush a 17.8 cm by 17.8 cm piece of fabric shaped into an approximately 6.5 cm diameter by 6.5 cm tall cup shape, while the now cup shaped fabric is surrounded by an approximately 6.5 cm diameter cylinder cup to maintain a uniform deformation of the cup shaped fabric. There can be gaps between a ring (not shown) and the forming cup, but at least four corners of the fabric must be fixedly pinched there between. The foot and cylinder cup are aligned to avoid contact between the cup walls and the foot that could affect the readings. The load is measured in grams, and recorded a minimum of twenty times per second while the foot is descending at a rate of about 406 mm per minute. The cup crush test also provides a value for the total energy required to crush a sample (the "cup crush energy") which is the energy over a 4.5 cm range beginning about 0.5 cm below the top of the fabric cup, i.e., the area under the curve formed by the load in grams on one axis and the distance the foot travels in millimeters on the other. Cup crush energy is reported in gm-mm (or inch-pounds). A lower cup crush value indicates a softer material. A suitable device for measuring cup crush is a model FTD-G-500 load cell (500 gram range) available from the Schaevitz Company, Pennsauken, N.J.

EXAMPLES

Example 1

Examples A-F of the wipe substrate are prepared as described below. The first layer of Examples A-F is uncreped through-air dried tissue. The second layer of Examples A-F is an airlaid nonwoven. The first layer basesheet is made using an uncreped through-air-dried tissue making process in which a headbox deposits an aqueous suspension of papermaking fibers between forming wires. The newly-formed web is transferred from the forming wire to a slower moving transfer fabric with the aid of a vacuum box. The web is then transferred to a through-air drying fabric and passed over through-air dryers to dry the web. After drying, the web is transferred from the through-air drying fabric to a reel fabric and thereafter briefly sandwiched between fabrics. The dried web remains on the fabric until it is wound up into a parent roll.

To form the tissue, a headbox was employed, through which the 100 percent softwood fibers are pumped in a single layer. The fiber was diluted to between 0.19 and 0.29 percent consistency in the headbox to ensure uniform formation. The resulting single-layered sheet structure was formed on a twin-wire, suction form roll. The speed of the forming fabric was 3304 feet per minute (fpm). The newly-formed web was then dewatered to a consistency of about 20 to 27 percent using vacuum suction from below the forming fabric before being transferred to the transfer fabric, which was traveling at 2800 fpm (18 percent rush transfer). A vacuum shoe pulling about 9 to 10 inches of mercury vacuum was used to transfer the web to the transfer fabric. A second vacuum shoe pulling about 5 to 6 inches of mercury vacuum was used to transfer the web to a t1205-2 through-air drying fabric manufactured by Voith Fabrics Inc. The web was carried over a pair of Honeycomb through-air dryers operating at temperatures of about 400 to 430° F. and dried to a final dryness of about 97 to 99 percent consistency. The dried cellulosic web was rolled onto a core to form a parent roll of tissue.

Then, the dried cellulosic sheet was put onto a fabric and a basesheet of airlaid nonwoven web was formed continuously on top of the dried cellulosic sheet. Weyerhaeuser CF405 bleached softwood kraft fiber in pulp sheet form was used as the fibrous material. This combined material was embossed by heated compaction rolls and transferred to an oven wire, where it was sprayed on the top side and the then bottom side with the a binder composition of a cationic polyacrylate that is the polymerization product of 96 mol % methyl acrylate and 4 mol % [2-(acryloyloxy)ethyl]trimethyl ammonium chloride and VINNAPAS® EZ123 in a 70:30 ratio was used to bond the substrate binder composition.

A series of Unijet® nozzles, Nozzle type 800050 or 730077, manufactured by Spraying Systems Co., Wheaton, Ill., operating at approximately 70 to 120 psi were used to spray the binder composition onto both sides of the fibrous material. Each binder composition was sprayed at approximately 15 percent binder solids with water as the carrier. The wet partially formed wipe substrate was carried through a dryer operating at 350 to 400° F. at a speed of 350 fpm to partially dry the wipe substrate. The partially dry wipe substrate was then wound on a core and then unwound and run through the 350 to 400° F. dryer a second time at a speed between 300 and 650 fpm to raise the temperature of the wipe substrate to 275 to 375° F. The total dry weight percent of binder add-on was varied based to the dry mass of the wipe substrate as illustrated in Table 3. The basesheet was machine-converted into sections of continuous web 5.5 inches wide by 56 inches long with perforations every 7 inches which were adhesively joined, fan-folded and applied with the wetting composition at 235 percent add-on to yield a fan-folded stack of wet wipes. A wetting composition that is used on commercially available wet wipes under the trade designation KLEENEX® COTTONELLE FRESH® Folded Wipes (Kimberly-Clark Corporation of Neenah, Wis.).

The exemplary dispersible wipes were tested for density in each layer, basis weight in each layer, caliper cup crush, and plate stiffness. Illustrative results are set forth below in Table 1.

TABLE 1

| Example | Density (Layer 1) (g/ccm) | Density (Layer 2) (g/ccm) | Basis Weight (gsm) (Layer 1) | Basis Weight (gsm) (Layer 2) | Binder add on (%) | Caliper (mm) | Cup Crush (g) | Plate Stiffness (N mm) |
|---|---|---|---|---|---|---|---|---|
| A | 0.3 | 0.09 | 60 | 15 | 4.7 | 0.59 | 51 | 0.44 |
| B | 0.3 | 0.09 | 45 | 30 | 5.7 | 0.76 | 53 | 0.46 |
| C | 0.3 | 0.09 | 30 | 30 | 8.3 | 0.63 | 51 | 0.44 |
| D | 0.3 | 0.09 | 75 | 15 | 5.6 | 0.59 | 86 | 0.75 |
| E | 0.3 | 0.09 | 30 | 45 | 6.7 | 0.90 | 61 | 0.53 |
| F | 0.3 | 0.09 | 75 | 30 | 4.8 | 0.86 | 56 | 0.49 |

Example 2

For example 2, two examples were prepared as described in Example A-F and compared to basesheet made of only uncreped through-air dried tissue, a basesheet made of only airlaid, KLEENEX® COTTONELLE FRESH® Flushable Moist Wipes and CHARMIN® Flushable Moist Wipes. The Examples were tested for density in each layer, basis weight in each layer, caliper cup crush, and plate stiffness. Illustrative results are set forth below in Table 2.

TABLE 2

| Example | Density (Layer 1) (g/ccm) | Density (Layer 2) (g/ccm) | Basis Weight (gsm) (Layer 1) | Basis Weight (gsm) (Layer 2) | Binder add on (%) | Caliper (mm) | Cup Crush (g) | Plate Stiffness (N mm) |
|---|---|---|---|---|---|---|---|---|
| Comparative A (COTTONELLE FRESH ® | 0.11 | — | 72 | — | 19 | 0.55 | 83 | 0.72 |
| Comparative B (Charmin ®) | 0.125 | — | 65 | — | 0 | 0.52 | 52 | 0.45 |
| Comparative C (Airlaid) | 0.14 | — | 100 | — | 19 | 0.57 | 125 | 1.09 |
| Comparative D (UCTAD) | 0.30 | — | 75 | — | 5% | 0.50 | 64 | 0.56 |
| G | 0.30 | 0.09 | 75 | 15 | 5% | 0.72 | 34 | 0.30 |
| H | 0.30 | 0.05 | 75 | 15 | 5% | 0.87 | 22 | 0.10 |

As can be seen by Table 2 above, one unique feature of the wipes described herein is a high caliper with lower stiffness than the comparative examples.

In addition, the comparative examples were tested to show in-use strength and break-up time in slosh box conditions. Illustrative results are illustrated in Table 3 below.

TABLE 3

| Example | In-use MD Tensile Strength (g/in) | Strength In-Use (GMT) (g/in) | In-use CD Tensile Strength (g/in) | Slosh Box Time to 1" Pieces (sec) |
|---|---|---|---|---|
| Comparative A (COTTONELLE FRESH ®) | 349 | 305 | 267 | 77 |
| Comparative B (Charmin ®) | 664 | 531 | 425 | — |
| Comparative C (Airlaid) | 664 | 531 | 425 | — |
| Comparative D (UCTAD) | 385 | 288 | 215 | 107 |
| G | 796 | 563 | 398 | 247 |
| H | 755 | 534 | 378 | 290 |

As can be seen by Table 3 above, the composite two-layer structure defined herein provides comparable or better in-use strength to comparative examples, but provides reduced slosh box time.

Other modifications and variations to the appended claims may be practiced by those of ordinary skill in the art, without departing from the spirit and scope as set forth in the appended claims. It is understood that features of the various examples may be interchanged in whole or part. The preceding description, given by way of example in order to enable one of ordinary skill in the art to practice the claimed invention, is not to be construed as limiting the scope of the invention, which is defined by the claims and all equivalents thereto.

What is claimed is:

1. A dispersible wet wipe comprising:

a wipe substrate having at least a first outer layer comprising a tissue web containing cellulose fibers, and a second outer layer comprising a nonwoven web;

a triggerable binder composition; and a wetting composition containing between about 0.4 and about 3.5 percent of an insolubilizing agent.

2. The dispersible wet wipe of claim 1 wherein said triggerable binder composition is present at an add-on rate of between about 1 and about 8 percent based on the total weight of the wipe substrate.

3. The dispersible wet wipe of claim 1 wherein the tissue web comprises an uncreped through-air dried tissue web.

4. The dispersible wet wipe of claim 1 wherein the wet wipe has an in-use machine direction tensile strength of greater than 300 grams per linear inch.

5. The dispersible wet wipe of claim 1 wherein the basis weight of the first outer layer is between about20 and about 80 grams per square meter, and wherein the basis weight of the second layer is between about 10 and about 60 grams per square meter.

6. The dispersible wet wipe of claim 1 wherein the wet wipe has a caliper of greater than 0.6 mm.

7. The dispersible wet wipe of claim 1 wherein the wet wipe has a plate stiffness of less than 0.75 N*mm.

8. The dispersible wet wipe of claim 1 wherein the wet wipe has a geometric mean tensile strength of at least 300 grams per linear inch.

9. A method of forming a dispersible substrate comprising:

forming a first layer, the first layer comprising a tissue web containing cellulose fibers;

forming a second layer, the second layer comprising a nonwoven web; and applying a triggerable binder composition to at least one side of the dispersible substrate, the triggerable binder composition containing between about 0.4 and about 3.5 percent of an insolubilizing agent.

10. The method of claim 9 wherein said triggerable binder composition is present at an add-on rate of between about 1 and about 8 percent based on the total weight of the wipe substrate.

11. The method of claim 9 wherein applying the triggerable binder composition to at least one side of the dispersible substrate further comprises applying the triggerable binder composition to the second layer at an add-on rate of between about 1 and about 4 percent based on the total weight of the wipe substrate and applying the triggerable binder composition to the first layer at an add-on rate of between about 0.5 and about 3 percent based on the total weight of the wipe substrate.

12. The method of claim 9 wherein the basis weight of the first layer is between about 20 and about 80 grams per square meter.

13. The method of claim 9 wherein the first layer comprises an uncreped through-air dried tissue web.

14. The method of claim 9 wherein the second layer comprises an airlaid nonwoven web.

* * * * *